US005445431A

United States Patent [19]

Johnston

[11] Patent Number: 5,445,431

[45] **Date of Patent: * Aug. 29, 1995**

[54] SEAT UPLIFT APPARATUS

[76] Inventor: Gary Johnston, P.O. Box 183, Cowarts, Ala. 36321

[ * ] Notice: The portion of the term of this patent subsequent to Apr. 19, 2011 has been disclaimed.

[21] Appl. No.: 144,034

[22] Filed: Nov. 1, 1993

Related U.S. Application Data

[63] Continuation-in-part of Ser. No. 759,233, Sep. 13, 1991, Pat. No. 5,303,892.

[51] Int. Cl.[6] ..... A47C 3/32

[52] U.S. Cl. ..... 297/339; 297/338; 297/411.3; 297/DIG. 10

[58] Field of Search ..... 297/339, 338, 337, DIG. 10, 297/411.3, 323; 4/560.1, 564.1, 565.1

[56] References Cited

U.S. PATENT DOCUMENTS

| | | | |
|---|---|---|---|
| 459,282 | 9/1891 | Gollon | 297/DIG. 10 |
| 2,788,527 | 4/1953 | Steven | 297/DIG. 10 |
| 2,850,075 | 4/1956 | Wilson | 155/30 |
| 3,233,868 | 5/1963 | Harvey et al. | 254/31 |
| 4,034,426 | 7/1977 | Hardwick et al. | 4/185 L |
| 4,888,833 | 12/1989 | Garcia et al. | 4/480 |
| 4,907,303 | 3/1990 | Baird | 4/480 |
| 4,929,022 | 5/1990 | Geraci | 297/313 |
| 5,303,982 | 4/1994 | Johnston | 297/339 |

FOREIGN PATENT DOCUMENTS

| | | |
|---|---|---|
| 1435559 | 4/1974 | United Kingdom . |
| 2183150 | 6/1987 | United Kingdom . |

*Primary Examiner*—James R. Brittain
*Attorney, Agent, or Firm*—Richard C. Litman

[57] ABSTRACT

A user-powered seat uplift apparatus including a structural frame unit, a mechanical uplift assembly unit and a power transfer mechanism connecting the two units allows the user to more easily obtain a standing position from a previous seated position. The structural frame unit is used to support and guide the mechanical uplift assembly unit. The mechanical uplift unit has two sections which can independently move vertically with respect to the structural frame unit. One section has a seat, the other has rails. When downward force is applied on the rails, the section having the rails moves vertically downward and produces an upward force in the section having the seat through the power transfer mechanism. This interface allows the user to more easily uplift themselves from a seated position and is especially useful for older and/or medically disabled persons.

8 Claims, 5 Drawing Sheets

SEAT UPLIFT APPARATUS

CROSS-REFERENCE TO RELATED APPLICATIONS

This application is a Continuation-In-Part of U.S. application Ser. No. 07/759,233, filed Sep. 13, 1991, now U.S. Pat. No. 5,303,892.

BACKGROUND OF THE INVENTION

1. Field of the Invention

The present invention relates to a mechanical sitting device. More particularly, the present invention relates to a sitting device from which the user may mechanically uplift themselves from a seated position to a point where a standing position may be more easily obtained.

2. Description of the Prior Art

Sitting devices designed to assist the user in obtaining a standing position from a previous seated position are known in the art. Conventionally, these sitting devices are relatively expensive, bulky, and weighty, making them difficult to move from place to place. Further, many of these devices use electrical power to uplift the user, therefor requiring proximity to electrical outlets, or the extra weight of batteries.

U.S. Pat. No. 459,282 to Gollon discloses an exercise apparatus which has a frame unit, uplift assembly, vertical support members, structural pulleys, guide elements, a seat member, rail members, a cable member, and a back support. The arrangement and interaction of these elements and the resultant device is unrelated to the present invention.

U.S. Pat. No. 2,788,527 to Steven discloses a bathtub which can be electrically raised and lowered between two walls using rollers and attached mercerized canvas.

U.S. Pat. No. 2,850,075 to Wilson discloses an invalid chair including a vertically adjustable carriage assembly. This carriage assembly is raised and lowered between supports through the use of a sling which can be lengthened or shortened using power means and a crank.

U.S. Pat. No. 4,034,426 to Hardwick et al. discloses a mechanical bath tub lift chair apparatus wherein the user rocks the chair to elevate the seat through a rachet system.

U.S. Pat. No. 4,888,833 to Garcia et al. discloses a cart for positioning a body on a toilet, having hydraulic means for lifting and lowering a seating means.

U.S. Pat. No. 4,907,303 to Baird discloses an orthopedic chair with a spring loaded pivoting seat.

U.S. Pat. No. 4,929,022 to Geraci discloses a chair, with a spring loaded pivoting seat, having a lifting means comprised of handle bars and a foot operated lever member.

U.K. Patent GB 1,435,559 discloses a chair including a motorized seat which can be raised and lowered without tilting relative to a base.

Published U.K. Patent Application GB 2,183,150 A discloses a chair including a seat which tilts forward when actuated by the user through pivotally attached tilting means.

None of the above inventions and patents, taken either singly or in combination, is seen to describe the instant invention as claimed.

SUMMARY OF THE INVENTION

The present invention comprises a mechanical seat uplift apparatus which includes a sitting device from which the user is uplifted from a seated position by pushing downward upon a set of rails or hand engagement handles, producing downward motion of said rails or hand engagement handles. This downward motion creates upward motion in a seat, to achieve a raised seat position. This raised seat position allows the user to more easily achieve an upright standing position.

Accordingly, it is a principal object of the invention to provide a mechanical user-powered seat uplift apparatus which may be easily operated by persons who normally have difficulty in standing from a seated position.

It is another object of the invention to provide sitting devices adaptable to any conventional use of seats, including toilets, wheelchairs, airplane seats, and stationary chairs.

These and other objects of the present invention will become readily apparent upon further review of the following specification and drawings.

BRIEF DESCRIPTION OF THE DRAWINGS

FIG. 1C is a side view of a third embodiment of the invention.

Similar reference characters denote corresponding features consistently throughout the attached drawings.

DETAILED DESCRIPTION OF THE PREFERRED EMBODIMENTS

Figure 1B:
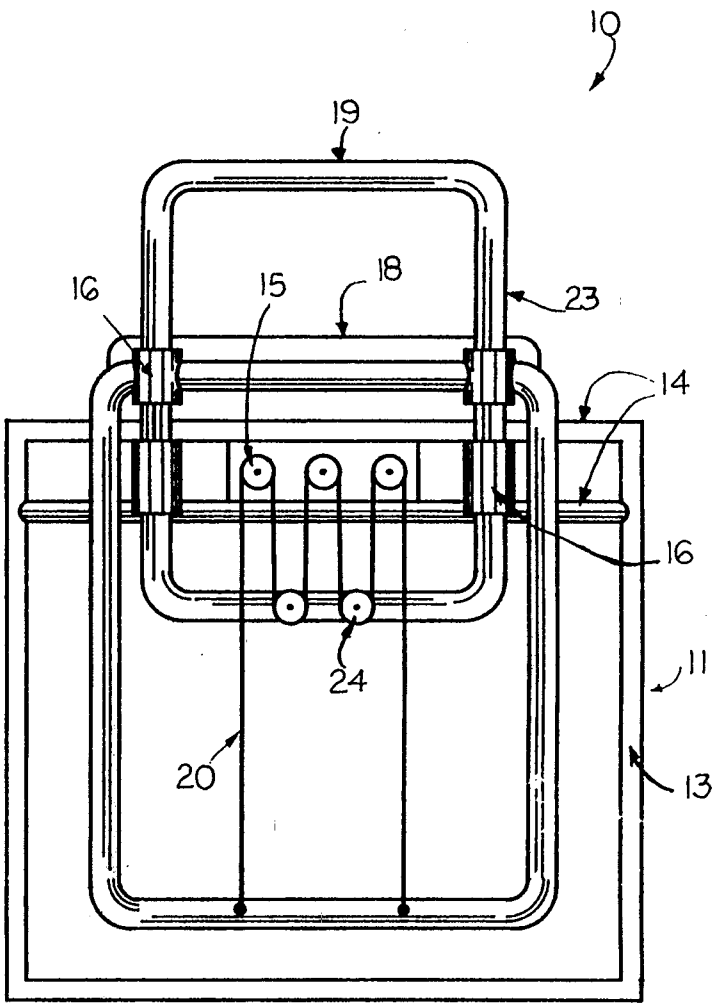
FIG. 1B is a side view of another embodiment of the invention.

As can be seen by reference to the drawings, and in particular FIGS. 1A–1D, the user-operated seat uplift apparatus that forms the basis of the present invention is designated generally by the reference numeral 10, and comprises a structural frame unit, a mechanical uplift unit, and a power translating mechanism.

The structural frame unit includes a frame 11, composed of vertical support members 13 and horizontal support members 14; mechanism engagement means 15 for engaging the power translating mechanism; and optionally, guide elements 16.

The mechanical uplift assembly unit comprises a seat 18 mounted to a first member 22, which supports the user while in a substantially horizontal seated position, and rails or hand engagement handles 19 disposed on each side of the seat mounted to a second member 23, wherein each member has mechanism engagement means, 25 and 24 respectively, for engaging the power translating mechanism 20, and is moveable in the substantially vertical direction independent of the other member, with respect to the structural frame unit. The mechanical uplift apparatus may optionally further comprise guide elements 16.

The power translating mechanism 20 operatively connects said first member, said second member, and said frame through their respective mechanism engagement means such that downward force on said rails or hand engagement handles translates to upward force on said seat.

The frame of the structural frame unit comprises vertical support members 13 and horizontal support members 14. The frame may optionally further comprise side plates 17. Said vertical support members, said horizontal support members, and optionally said side plates together form a rigid structure. This may be accomplished by any appropriate arrangement such as unitary construction, jointed construction between said horizontal support members and said vertical support members, or braced construction between said horizontal support members, said vertical support members, and said side plates.

The mechanism engagement means 15 of the structural frame unit may be a structural feature of said frame, and can be holes, grooves, sleeves, brackets, pins, or hooks therein. Alternatively, the mechanism engagement means is attached to said frame and may further incorporate separately movable parts, such as pulleys, wheels, gears, glides, grips, and rollers. Preferred mechanism engagement means of the structural frame unit include pins, sleeves, pulleys, and holes. For example, in FIG. 1A, the structural frame unit further comprises a plate placed between, and attached to, two horizontal support members 14 of the frame 11. Therein, the mechanism engagement means 15 are pulleys attached to said plate.

The optional guide elements 16 of the structural frame unit may also be a structural feature of said frame 11 or, alternatively, are attached to said frame, and may optionally further comprise rollers or a low friction coating. These guide elements receive vertical support elements of the mechanical uplift unit. Preferred guide elements include sleeves and grooves. For example, in FIG. 1B, guide elements 16 are sleeves attached between two horizontal support members of said frame 11.

The seat 18 of the mechanical uplift assembly unit has appropriate features for the intended use of the present device. For example, when the present device is incorporated into a toilet, such as shown in FIG. 3, the conventional features of toilet seats, such as a central void, are incorporated. Preferably, the seat further comprises a back support, such as shown in FIG. 2, 28, and FIG. 5, 32. The seat is preferably made of lightweight materials such as cloth, lightweight metals, plastic, or combinations thereof.

Said seat 18 is mounted to a first member 22, which comprises at least one substantially vertical support element of substantially constant horizontal dimension, and means for supporting said seat. Said means for supporting said seat are any appropriate means which fixedly attach seat 18 to said first member 22, including adhesive, brackets and screws, or the like. Preferably said first member comprises two or more vertical support elements. Optionally, said first member may further comprise a horizontal support element. The vertical support elements, means for supporting said seat, and optional horizontal elements are arranged by any appropriate manner, such as unitary construction, jointed construction, or the like, such that the first member is substantially rigid. The first member comprises a mechanism engagement means 25, which may be of the same type used in the structural frame unit, and may be a structural feature of said first member, or be separately attached.

Rails or hand engagement handles 19 are disposed on each side of said seat which are mounted to a second member 23, wherein said second member comprises at least one substantially vertical support element of substantially constant horizontal dimension. As with the first member, the second member may further comprise optional horizontal support elements, and is substantially rigid. A mechanism engagement means 24, which may be of the same type used in the structural frame unit, is a structural feature of said second member, or is separately attached.

The optional guide elements 16 of the mechanical uplift unit may also be a structural feature of said first member or said second member, or alternatively, guide elements are attached to said first or second member, and may optionally further comprise rollers or a low friction coating. These guide elements receive vertical support members 13 of the frame 11, and/or vertical support elements of the other member 22 or 23. Preferred guide elements include sleeves and grooves. For example, in FIG. 1A, guide elements 16 are sleeves attached to horizontal support elements of said first member 22, which receive vertical support members 13 of said frame 11, and also attached to horizontal support elements of said second member 23, which receive vertical support elements of said first member 22.

The power translating mechanism 20 operatively connects said first member, said second member, and said frame through their respective mechanism engaging means such that downward force on said rails or hand engagement handles 19 translates to upward force on said seat 18. This may be accomplished through various power transfer schemes. Preferably, the power transfer mechanism comprises a linkage system utilizing a cable or tether. Accordingly, the preferable mechanism engagement means of two of the group selected from said first member, said second member, and said frame are pulleys. The third of the group would have, as mechanism engagement means, grips, holes or grooves, which would hold the two ends of the tether or cable. More preferably, each of said first member, said second member, and said frame comprises at least two of said mechanism engagement means, as shown in FIGS. 1A–1D wherein said tether or cable 20 operatively connects: the first member 24 through a mechanism attachment means of the hole or grip type 25, the second member 23 through pulleys 24, and the frame 11 through pulleys 15. Different configurations may be used to produce different ratios of first member travel and second member travel, in the vertical direction.

Alternatively, the power transfer mechanism comprises a linkage system wherein a rigid linkage element is rotated about a fixed axis, said axis being supplied by a mechanism engagement means fixed to said frame. Two elongated slots exist in said linkage element, which are radial from said axis, and are located on each side of said axis. Each of said first member and said second member have pins as mechanism engagement means which slidably fit within said elongated slots of said linkage system.

Previous U.S. application Ser. No. 07/759,233 of which this is a C-I-P is herein incorporated by reference wherein these alternative linkage systems are further described. The invention has the advantage of utilizing other embodiments of power transfer mechanism and mechanism engagement means which are available in the art, so long as the transfer of downward motion of the second member is translated to the upward motion of the first member.

The seat 18 be attached to said first member 22 must maintain a substantially horizontal position throughout said upward motion of said first member. This may be accomplished by having the frame and first member sized so that movement of said first member is restricted to the vertical direction, being confined by the frame. Alternatively, at least one guide 16 can be incorporated in or attached to the group selected from said frame 11, said first member 22, and said second member 23; and at least a different one of the group selected from said frame, said first member, and said second member comprises at least one vertical support member or element, wherein said guide is adapted to receive said vertical support member or element and slidably guide said vertical support member in a substantially vertical direction with respect to said frame, such that said frame and said one selected from the group selected from said first member and said second member are slidably coupled. Further guides 16 may be optionally incorporated or attached to said first member or said second member so that one of said first or second member may be slidably coupled to the other, or to said frame. Preferably, either both of said first member and said second member are individually slidably coupled to said frame; one of said first member or said second member is slidably coupled to said frame, and the other is slidably coupled to the first or second member slidably coupled to said frame; or both of said first and second members are individually slidably coupled to said frame and are further slidably coupled to each other. The vertical support member or element, which is received by a guide, in any of the above manners may be the same or a different vertical support member which incorporates or has attached a mechanism engagement means.

With reference to the drawings, FIGS. 1A–1D show four embodiments of the present invention with alternative ways for slidably coupling said first member, said second member, and said frame. These drawings further demonstrate a preferred embodiment of the instant power transfer mechanism.

Figure 1A:
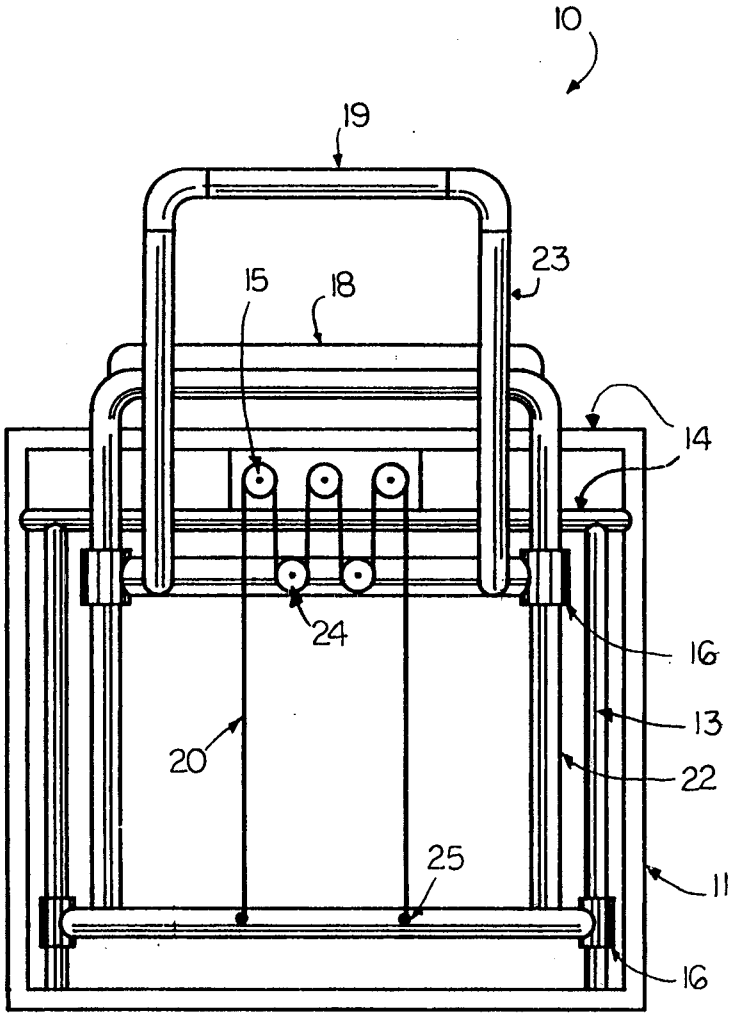
FIG. 1A is a side view of one embodiment of the invention.
Figure 1B:
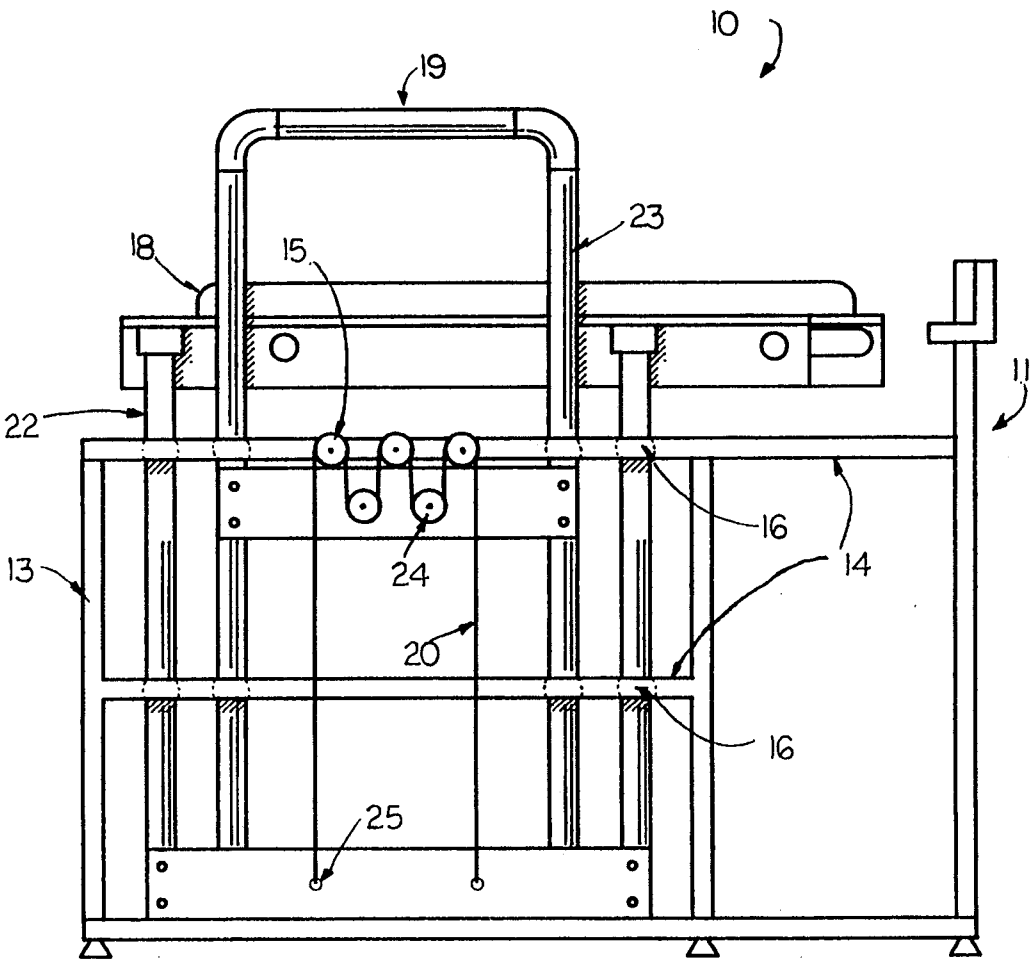

FIG. 1A shows one arrangement wherein the first member is slidably coupled to the frame and the second member is slidably coupled to said first member. Guides 16 are provided on said first member which slidably receives vertical support members 13 of said frame, and on said second member which slidably receives vertical support elements of said first member 22. This embodiment also shows a pulley and tether power transfer mechanism and engagement means wherein the ends of the tether 20 are attached to said first member, and the tether operatively connects said second member and said frame through pulleys 24 and 15. Downward motion on rail 19, causes the tether 20, looped under pulleys 24 and over pulleys 15, to pull the first member 22 and accordingly the seat 18 upwards.

FIG. 1B shows another arrangement wherein the second member is slidably coupled to the frame and the first member is slidably coupled to said second member. Guides 16 are provided on said frame 11 which slidably receives vertical support elements of said second member 23, and on said second member which slidably receives vertical support elements of said first member 22.

FIG. 1C shows a third arrangement wherein both the first member 22 and second member 23 separately are slidably coupled to the frame 11, and said first member and said second member are slidably coupled to each other.

Figure 1D:
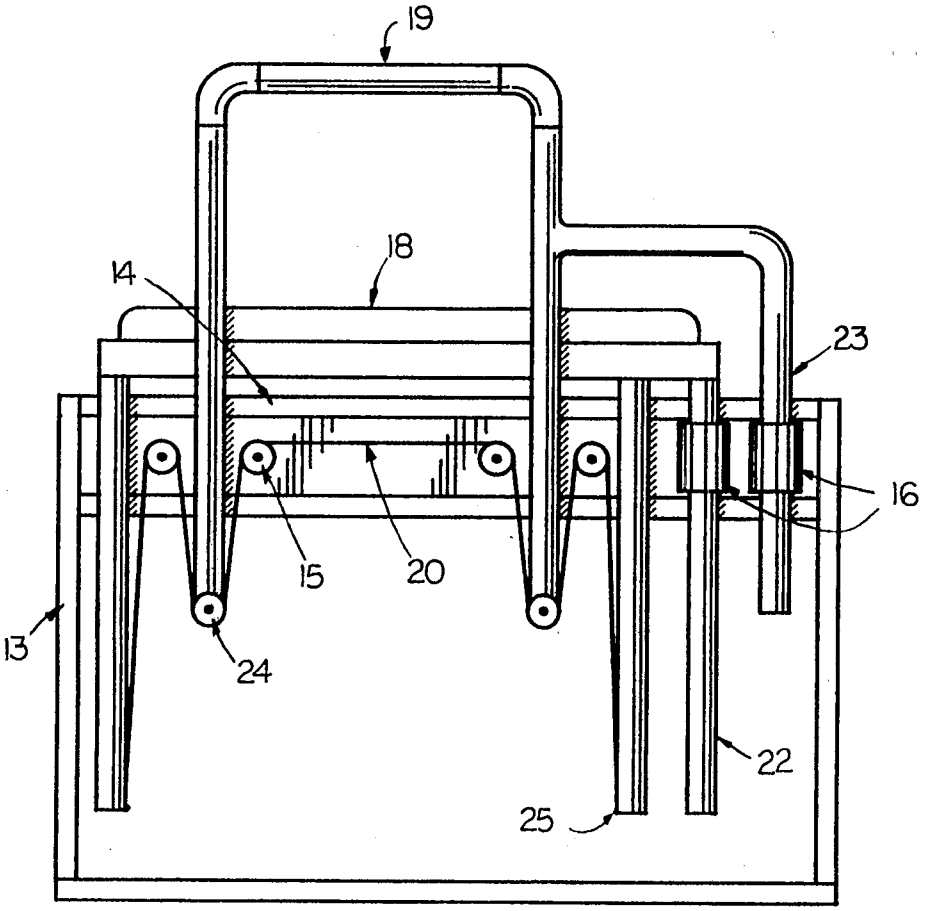
FIG. 1D is a side view of a fourth embodiment of the invention

FIG. 1D shows a fourth arrangement wherein both the first member 22 and second member 23 are separately coupled to the frame. Separate vertical support elements are utilized in both said first member and said second member for connection to the power transfer mechanism than for slidably coupling to the frame.

Figure 2:
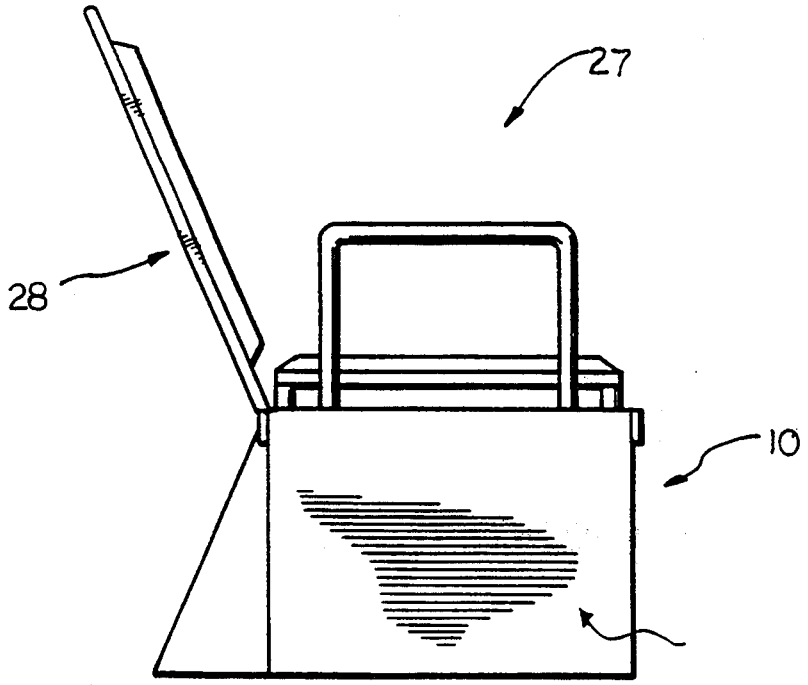
FIG. 2 is a side view of a chair incorporating an embodiment of the present invention.
Figure 3:
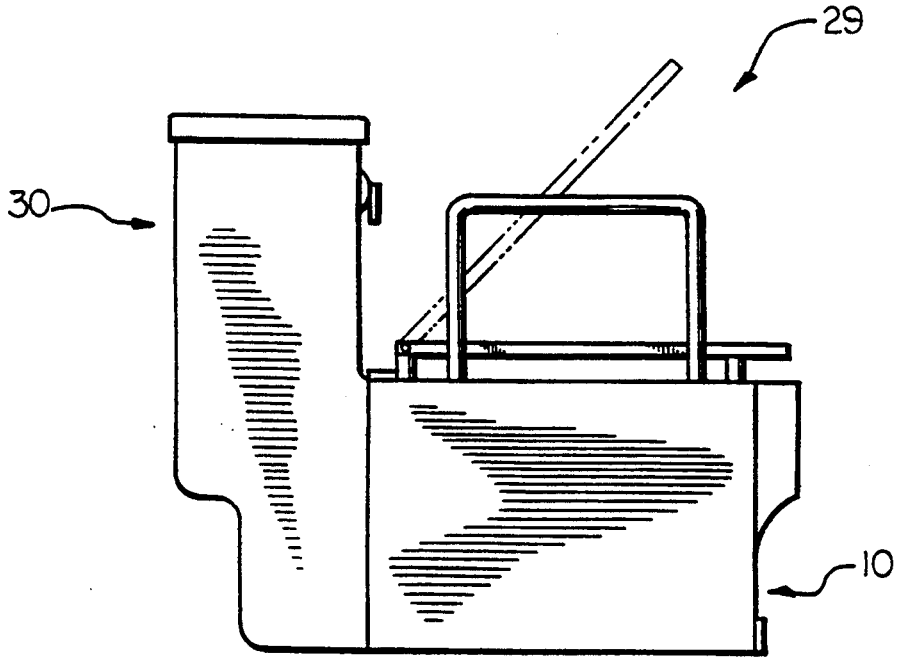
FIG. 3 is a side view of a toilet incorporating an embodiment of the present invention.
Figure 4:
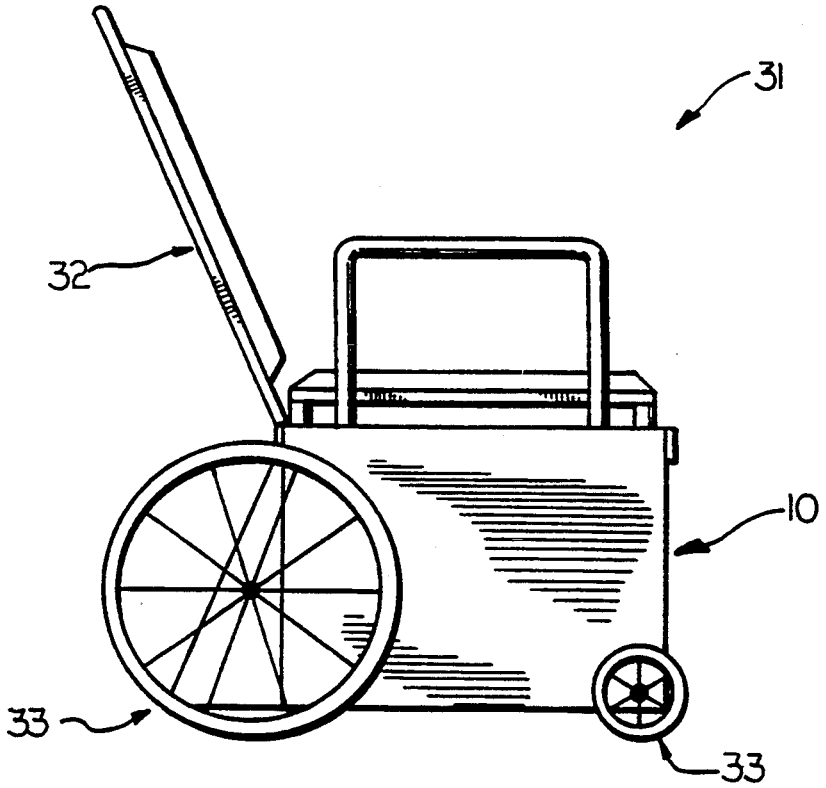
FIG. 4 is a side view of a wheelchair incorporating an embodiment of the present invention.

As can be seen in FIGS. 2–4, the instant apparatus may be incorporated into sitting devices of various types, thereby allowing users of these types of devices to benefit from the advantages of the present invention. Optional attachments appropriate to the use of these sitting devices may be further attached, such as wheels 33 in the wheelchair 31, toilet tank 30 in toilet 29, and cushions in chair 27.

It is to be understood that the present invention is not limited to the sole embodiment described above, but encompasses any and all embodiments within the scope of the following claims.

I claim:

1. A seat uplift apparatus comprising:

a frame;

a seat mounted to a first member, said first member being movable in a substantially vertical direction with respect to said frame;

a hand engagement handle mounted to a second member for receiving a downward force from a user, said second member being movable independently of said first member in the substantially vertical direction with respect to said frame; and a power translating mechanism operatively connected between said first member, said second member, and said frame for translating the downward force applied by the user on said hand engagement handle into an upward force on the seat, thereby assisting the user into a raised position.

2. The seat uplift apparatus according to claim 1, wherein said first member is slidably coupled to said frame, and said second member is slidably coupled to said first member.

3. The seat uplift apparatus according to claim 1, wherein said second member is slidably coupled to said frame, and said first member is slidably coupled to said second member.

4. The seat uplift apparatus according to claim 1, wherein said first member and said second member are separately slidably coupled to said frame.

5. The seat uplift apparatus according to claim 4, wherein said first member and said second member are slidably coupled to each other.

6. The seat uplift apparatus according to claim 4, wherein said first member further comprises:

at least one vertical support element connected to and extending downwardly from said seat and slidably coupled to said frame; and at least one different vertical support element connected to and extending downwardly from said seat and connected to said power translating mechanism.

7. The seat uplift apparatus according to claim 4, wherein said second member further comprises:

at least one vertical support element connected to and extending downwardly from said hand engagement handle and slidably coupled to said frame; and at least one different vertical support element connected to and extending downwardly from said hand engagement handle and connected to said power translating mechanism.

8. The seat uplift apparatus according to claim 1, wherein said power transfer mechanism is a tether; said first member further comprises a mechanism engagement means which holds the ends of said tether; said frame and said second member further comprise mechanism engagement means, which are pulleys; such that said tether operatively connects said mechanism engagement means of said first member, said second member, and said frame.

* * * * *